US009057153B2

(12) United States Patent
Yu

(10) Patent No.: US 9,057,153 B2
(45) Date of Patent: Jun. 16, 2015

(54) DRYER APPLIANCE WITH AN IMPELLER ASSEMBLY

(71) Applicant: General Electric Company, Schenectady, NY (US)

(72) Inventor: Zhiquan Yu, Mason, OH (US)

(73) Assignee: General Electric Company, Schenectady, NY (US)

( * ) Notice: Subject to any disclaimer, the term of this patent is extended or adjusted under 35 U.S.C. 154(b) by 145 days.

(21) Appl. No.: 14/032,637

(22) Filed: Sep. 20, 2013

(65) Prior Publication Data

US 2015/0082653 A1 Mar. 26, 2015

(51) Int. Cl.

*D06F 58/00* (2006.01)
*D06F 58/10* (2006.01)
*D06F 58/08* (2006.01)

(52) U.S. Cl.

CPC ..... *D06F 58/10* (2013.01); *D06F 58/08* (2013.01)

(58) Field of Classification Search

CPC ..... F26B 11/00; F26B 11/02; D06F 58/00; D06F 58/20; F04D 29/38; F04D 29/44
USPC ..... 34/595, 601, 606, 610; 68/5 C, 5 R, 19, 68/20; 416/186 R, 241 A
See application file for complete search history.

(56) References Cited

U.S. PATENT DOCUMENTS

| | | | | |
|---|---|---|---|---|
| 3,831,292 | A * | 8/1974 | DePas | 34/75 |
| 4,360,977 | A * | 11/1982 | Frohbieter | 34/86 |
| 7,984,568 | B2 * | 7/2011 | Dittmer et al. | 34/595 |
| 8,051,578 | B2 * | 11/2011 | Kohlrusch | 34/381 |
| 8,104,191 | B2 * | 1/2012 | Ricklefs et al. | 34/474 |
| 8,261,466 | B2 | 9/2012 | Latack et al. | |
| 2012/0096733 | A1 * | 4/2012 | Sans Rovira et al. | 34/108 |
| 2014/0157613 | A1 * | 6/2014 | McLain | 34/139 |
| 2015/0082653 | A1 * | 3/2015 | Yu | 34/138 |

FOREIGN PATENT DOCUMENTS

| | | | | |
|---|---|---|---|---|
| GB | 2095806 | A * | 10/1982 | F26B 21/10 |
| JP | S6075800 | | 4/1985 | |
| JP | 2008067746 | | 3/2008 | |
| JP | 2008240590 | | 10/2008 | |
| KR | 2007063997 | A * | 6/2007 | |

* cited by examiner

*Primary Examiner* — Stephen Gravini
(74) *Attorney, Agent, or Firm* — Dority & Manning, P.A.

(57) ABSTRACT

The present subject matter provides a dryer appliance. The dryer appliance includes an impeller assembly. The impeller assembly is rotatable about an axis of rotation in order to urge a flow of air through a drum of the dryer appliance. The impeller assembly includes a base plate and an annular front plate spaced apart from the base plate. A plurality of blades extends between the base plate and the annular front plate. The size and position of the base plate, the annular front plate and the plurality of blades relative to one another can assist with urging the flow of air through the drum of the dryer appliance.

18 Claims, 6 Drawing Sheets

DRYER APPLIANCE WITH AN IMPELLER ASSEMBLY

FIELD OF THE INVENTION

The present subject matter relates generally to impeller assemblies for appliances, e.g., dryer appliances.

BACKGROUND OF THE INVENTION

Dryer appliances generally include a cabinet with a drum rotatably mounted therein. A motor can selectively rotate the drum during operation of the dryer appliance, e.g., to tumble articles located within a chamber defined by the drum. Dryer appliances also generally include a heater assembly that passes heated air through the chamber of the drum in order to dry moisture laden articles disposed within the chamber. To circulate heated air, the dryer appliance can include an impeller. The impeller can be rotated by the motor that also rotates the drum.

During operation of the dryer appliance, the impeller can urge a flow of heated air into the chamber of the drum. Such heated air can absorb moisture from articles disposed within the chamber. In turn, the impeller can urge moisture laden air out of the chamber through a vent. The vent can be connected to household ductwork that directs the moisture laden air outdoors.

Performance of a dryer appliance can be affected by the flow of heated air. For example, dryer appliance performance can be improved by generating a large volume of heated air. Conversely, dryer appliance performance can be negatively affected if the heating assembly generates a low volume of heated air.

To improve dryer performance, a size of the impeller can be increased. However, space with a dryer appliance is generally limited or constrained. Thus, increasing a size of the impeller can be difficult. To improve dryer performance, certain dryer appliances include a second motor configured to rotate the impeller. Thus, the second motor rotates the impeller rather than the motor that rotates the drum. However, motors can be expensive, and adding the second motor to the dryer appliance can increase the cost of the dryer appliance.

Accordingly, a dryer appliance with features for improving air flow through the dryer appliance would be useful. In particular, a dryer appliance with features for improving air flow through the dryer appliance without requiring a relatively large impeller or adding a second motor to the dryer appliance would be useful.

BRIEF DESCRIPTION OF THE INVENTION

The present subject matter provides a dryer appliance. The dryer appliance includes an impeller assembly. The impeller assembly is rotatable about an axis of rotation in order to urge a flow of air through a drum of the dryer appliance. The impeller assembly includes a base plate and an annular front plate spaced apart from the base plate. A plurality of blades extends between the base plate and the annular front plate. The size and position of the base plate, the annular front plate and the plurality of blades relative to one another can assist with urging the flow of air through the drum of the dryer appliance. Additional aspects and advantages of the invention will be set forth in part in the following description, or may be apparent from the description, or may be learned through practice of the invention.

In a first exemplary embodiment, a dryer appliance is provided. The dryer appliance includes a cabinet that defines a vent and a drum rotatably mounted within the cabinet. The drum defines a chamber for receipt of articles for drying. A conduit connects the chamber of the drum and the vent of the cabinet such that the chamber of the drum and the vent of the cabinet are in fluid communication. The dryer appliance also includes a motor and an impeller assembly. The impeller assembly has an axis of rotation about which the impeller assembly is rotatable. The impeller assembly is in mechanical communication with the motor. The impeller assembly is rotatable about the axis of rotation by the motor in order to urge a flow of air from the chamber of the drum to the vent of the cabinet through the conduit. The impeller assembly defines a radial direction, a circumferential direction and an axial direction. The impeller assembly includes a base plate and an annular front plate spaced apart from the base plate along the axial direction. The annular front plate has an inner edge that is spaced apart from the axis of rotation of the impeller assembly by a width, WO, along the radial direction. A plurality of blades extends between the base plate and the annular front plate along the axial direction. The blades of the plurality of blades are spaced apart from each other along the circumferential direction. Each blade of the plurality of blades has a leading edge. The leading edge of each blade of the plurality of blades spaced apart from the axis of rotation of the impeller assembly by a width, WB, along the radial direction. A ratio of the width WO to the width WB is greater than about one and one tenth and less than about one and one half.

In a second exemplary embodiment, a dryer appliance is provided. The dryer appliance includes a cabinet that defines a vent and a drum rotatably mounted within the cabinet. The drum defines a chamber for receipt of articles for drying. A conduit connects the chamber of the drum and the vent of the cabinet such that the chamber of the drum and the vent of the cabinet are in fluid communication. The dryer appliance also includes a motor and an impeller assembly. The impeller assembly has an axis of rotation about which the impeller assembly is rotatable. The impeller assembly is in mechanical communication with the motor. The impeller assembly is rotatable about the axis of rotation by the motor in order to urge a flow of air from the chamber of the drum to the vent of the cabinet through the conduit. The impeller assembly defines a radial direction, a circumferential direction and an axial direction. The impeller assembly includes a base plate and an annular front plate spaced apart from the base plate by a height, h, along the axial direction. The annular front plate has an inner edge and an outer edge. The inner edge of the annular front plate is spaced apart from the axis of rotation of the impeller assembly along the radial direction. The outer edge of the annular front plate is spaced apart from the inner edge of the annular front plate by a width, WA, along the radial direction. A ratio of the width WA to the height h is greater than about six tenths and less than about one and two tenths. A plurality of blades extends between the base plate and the annular front plate along the axial direction. The blades of the plurality of blades are spaced apart from each other along the circumferential direction.

In a third exemplary embodiment, a dryer appliance is provided. The dryer appliance includes a cabinet that defines a vent and a drum rotatably mounted within the cabinet. The drum defines a chamber for receipt of articles for drying. A conduit connects the chamber of the drum and the vent of the cabinet such that the chamber of the drum and the vent of the cabinet are in fluid communication. The dryer appliance also includes a motor and an impeller assembly. The impeller assembly has an axis of rotation about which the impeller assembly is rotatable. The impeller assembly is in mechanical communication with the motor. The impeller assembly is rotatable about the axis of rotation by the motor in order to urge a flow of air from the chamber of the drum to the vent of the cabinet through the conduit. The impeller assembly defines a radial direction, a circumferential direction and an axial direction. The impeller assembly includes a base plate and an annular front plate spaced apart from the base plate along the axial direction. The impeller assembly includes a base plate having an outer edge that is spaced apart from the axis of rotation of the impeller assembly by a width, WP, along the radial direction. An annular front plate is spaced apart from the base plate along the axial direction. A plurality of blades extends between the base plate and the annular front plate along the axial direction. The blades of the plurality of blades are spaced apart from each other along the circumferential direction. Each blade of the plurality of blades has a trailing edge. The trailing edge of each blade of the plurality of blades is spaced apart from the axis of rotation of the impeller assembly by a width, WL, along the radial direction. A ratio of the width WP to the width WL is greater than about eight tenths.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
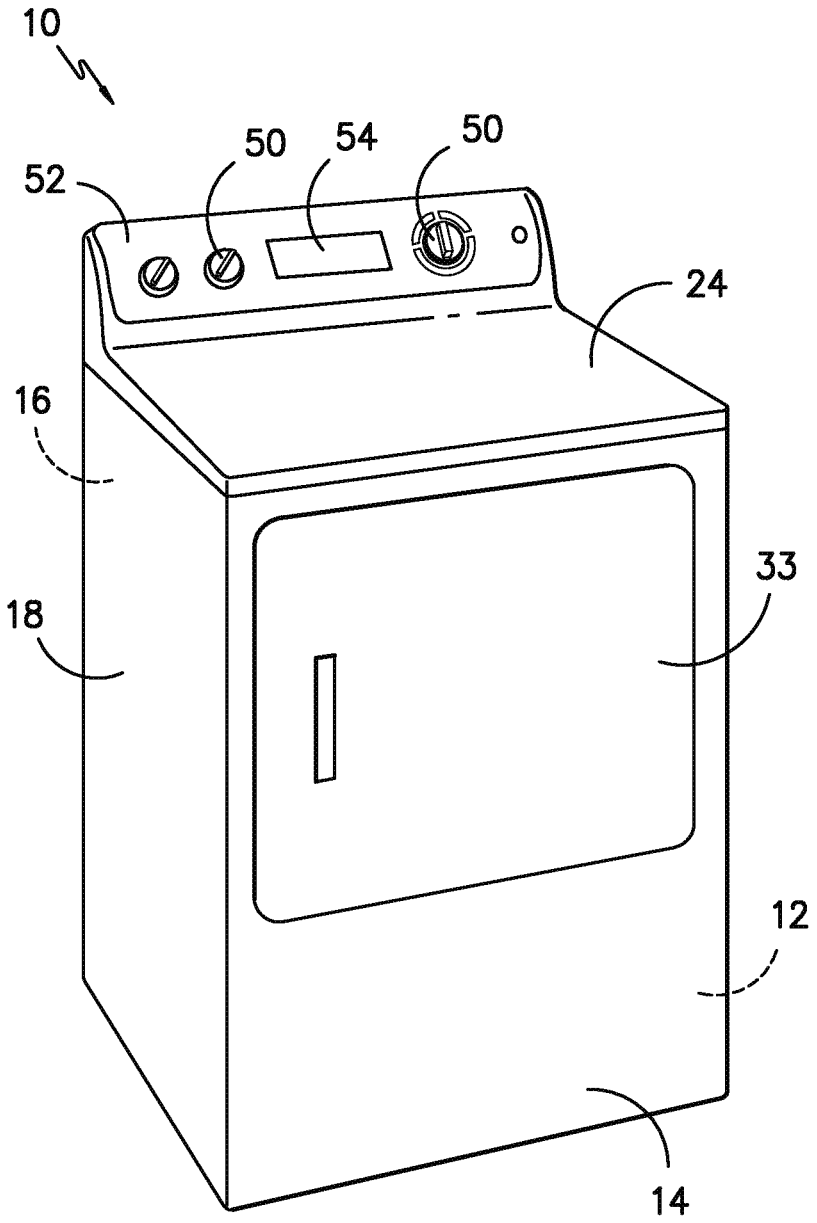
FIG. 1 provides a perspective view of a dryer appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to fabrics, textiles, garments (or clothing), and linens. Furthermore, the term "load" or "laundry load" refers to the combination of articles that may be washed together in a washing machine or dried together in a laundry dryer (i.e., a clothes dryer) and may include a mixture of different or similar articles of different or similar types and kinds of fabrics, textiles, garments and linens within a particular laundering process.

Figure 2:
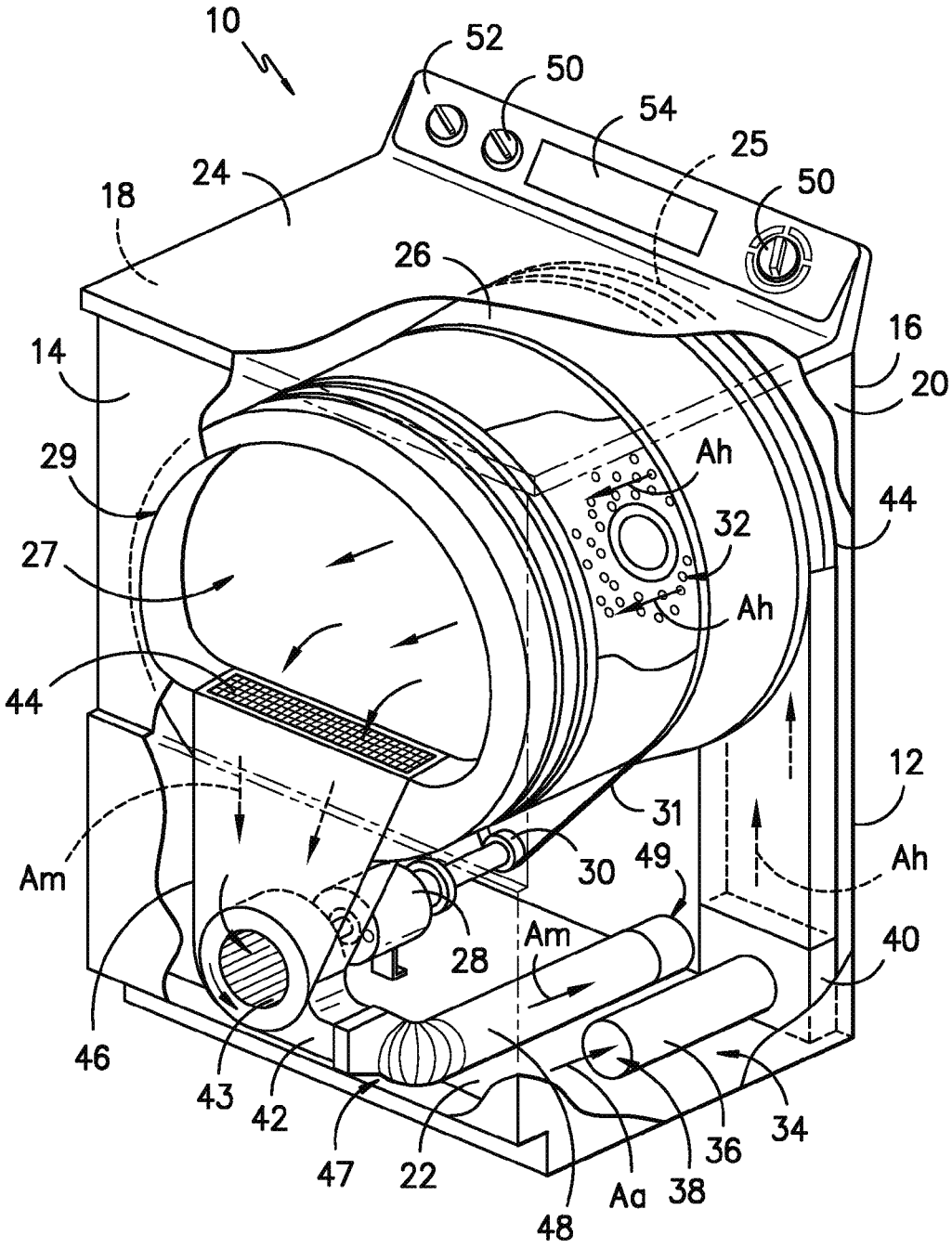
FIG. 2 provides a perspective view of the exemplary dryer appliance of FIG. 1 with a portion of a cabinet of the exemplary dryer appliance removed to reveal certain internal components of the exemplary dryer appliance.

FIGS. 1 and 2 illustrate a dryer appliance 10 according to an exemplary embodiment of the present subject matter. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is a gas dryer appliance with a combustion chamber 36. In alternative exemplary embodiments, dryer appliance 10 may be an electric dryer appliance with electric heating elements replacing combustion chamber 36.

Dryer appliance 10 includes a cabinet 12 having a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis. Drum 26 is generally cylindrical in shape and defines a chamber 27 for receipt of articles for drying.

Drum 26 also defines an opening 29 for permitting access to the chamber 27 of drum 26. Opening 29 of drum 26, e.g., permits loading and unloading of clothing articles and other fabrics from chamber 27 of drum 26. A door 33 is rotatably mounted at opening 29 and selectively hinders access to chamber 27 of drum 26 through opening 29.

Drum 26 includes a rear wall 25 rotatably supported within cabinet 12 by a suitable fixed bearing. Rear wall 25 can be fixed or can be rotatable. A motor 28 rotates the drum 26 about the horizontal axis through a pulley 30 and a belt 31. Motor 28 is also in mechanical communication with an air handler 42 such that motor 28 rotates an impeller assembly 43, e.g., a centrifugal impeller assembly, of air handler 42. Air handler 42 is configured for drawing air through chamber 27 of drum 26, e.g., in order to dry articles located therein as discussed in greater detail below. In alternative exemplary embodiments, dryer appliance 10 may include an additional motor (not shown) for rotating impeller assembly 43 of air handler 42 independently of drum 26.

Drum 26 is configured to receive heated air that has been heated by a heater assembly 34, e.g., in order to dry damp articles disposed within chamber 27 of drum 26. Heater assembly 34 includes a combustion chamber 36. As discussed above, during operation of dryer appliance 10, motor 28 rotates drum 26 and impeller assembly 43 of air handler 42 such that air handler 42 draws air through chamber 27 of drum 26 when motor 28 rotates impeller assembly 43. In particular, ambient air, shown with arrow $A_a$, enters combustion chamber 36 via an inlet 38 due to air handler 42 urging such ambient air $A_a$ into inlet 38. Such ambient air $A_a$ is heated within combustion chamber 36 and exits combustion chamber 36 as heated air, shown with arrow $A_h$. Air handler 42 draws such heated air $A_h$ through a back duct 40 to drum 26. The heated air $A_h$ enters drum 26 through a plurality of holes 32 defined in rear wall 25 of drum 26.

Within chamber 27, the heated air $A_h$ can accumulates moisture, e.g., from damp articles disposed within chamber 27. In turn, air handler 42 draws moisture laden air, shown as arrow $A_m$, through a screen filter 44 which traps lint particles. Such moisture laden air $A_m$, then enters a front duct 46 and is passed through air handler 42 to an exhaust duct 48. From exhaust duct 48, such moisture laden air $A_m$, passes out of clothes dryer 10 through a vent 49 defined by cabinet 12.

Front duct 46 and exhaust duct 48 form a conduit 47 that extends between and connects chamber 27 of drum 26 and vent 49. Conduit 47 places chamber 27 of drum 26 and vent 49 in fluid communication in order to permit moisture laden air $A_m$, to exit dryer appliance 10. Air handler 42 is in fluid communication with conduit 47, and impeller assembly 43 of air handler 42 is positioned within conduit 47.

A cycle selector knob 50 is mounted on a cabinet backsplash 52 and is in communication with a controller 54. Signals generated in controller 54 operate motor 28 and heater assembly 34 in response to a position of selector knob 50. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or memory elements such as e.g., electrically erasable, programmable read only memory (EEPROM).

Figure 3:
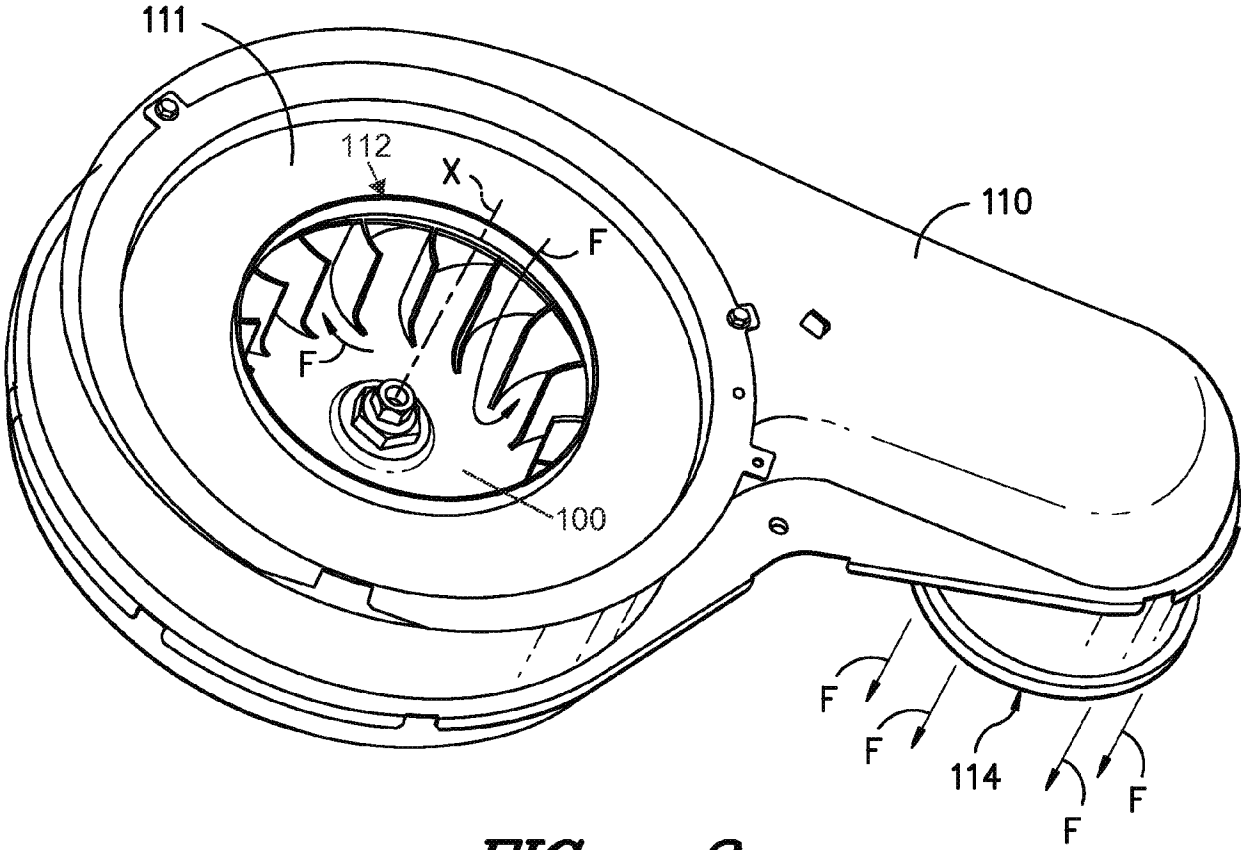
FIGS. 3 and 4 provide perspective views of an impeller assembly according to an exemplary embodiment of the present subject matter mounted within a casing.
Figure 4:
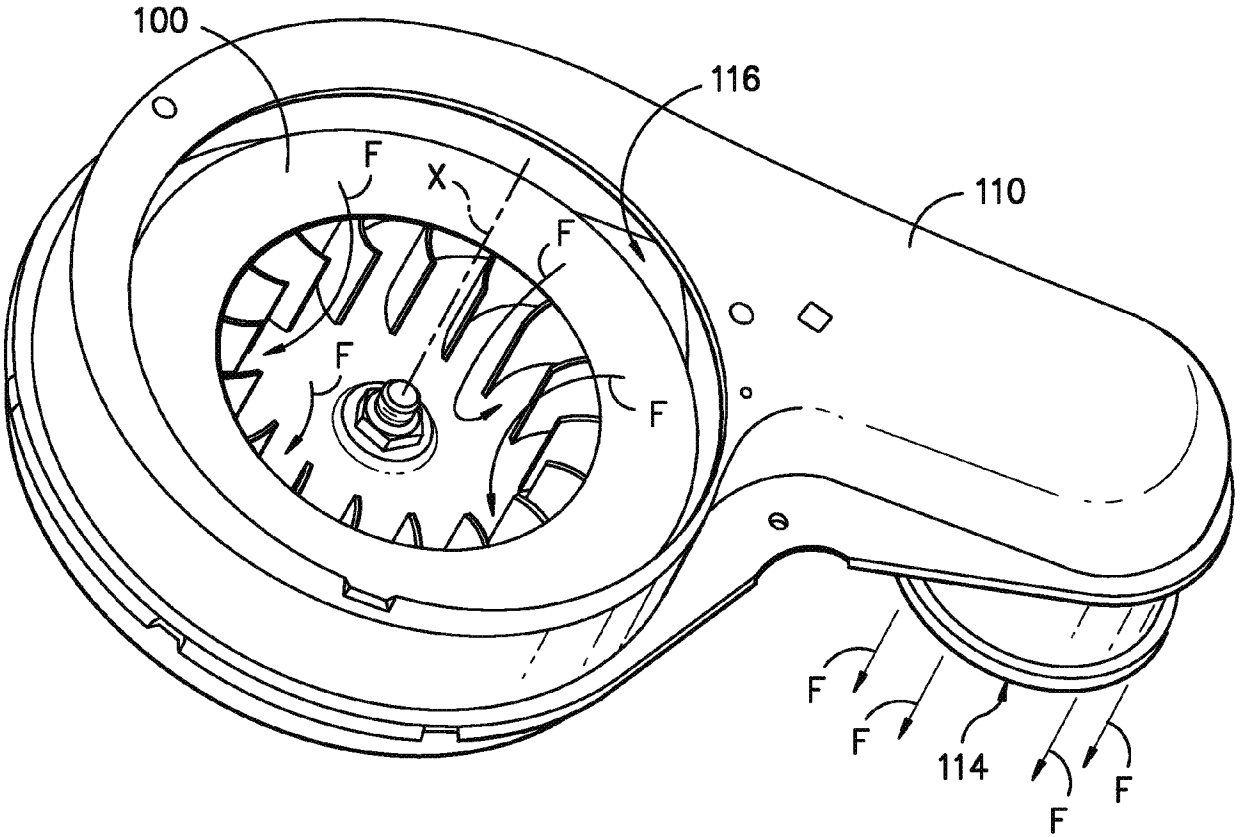

FIGS. 3 and 4 provide perspective views of a blade wheel or impeller assembly 100 according to an exemplary embodiment of the present subject matter mounted within a housing or casing 110. Impeller assembly 100 and casing 110 may be used with any suitable dryer appliance. As an example, impeller assembly 100 may be used in dryer appliance 10 as impeller assembly 43 (FIG. 2). Impeller assembly 100 includes features for drawing sufficient heated air into chamber 27 of drum 26, e.g., in order to dry articles therein.

Casing 110 defines an inlet 112, an outlet 114 and a flow passage 116. In particular, a cover plate 111 (FIG. 3) of casing 110 defines inlet 112. Flow passage 116 extends between inlet 112 of casing 110 and outlet 114 of casing 110. Thus, flow passage 116 places inlet 112 of casing 110 in fluid communication with outlet 114 of casing 110 such that flows of air (shown with arrows F) can enter casing 110 at inlet 112 of casing 110 and flow into flow passage 116. Inlet 112 of casing 110 may be positioned at or mounted to front duct 46 of dryer appliance 10 in order to receive moisture laden air $A_m$, from chamber 27 of drum 26. Flows of air F can flow through casing 110 in flow passage 116 to outlet 114 of casing 110. At outlet 114 of casing 110, flows of air F can exit casing 110. Outlet 114 of casing 110 may be positioned at or mounted to exhaust duct 48 of dryer appliance 10 in order to direct moisture laden air $A_m$, out of casing 110 and/or dryer appliance 10.

Impeller assembly 100 is position within casing 110, e.g., within flow passage 116. Impeller assembly 100 has an axis of rotation X about or on which impeller assembly 100 is rotatable. When impeller assembly 100 is rotating about the axis of rotation X, impeller assembly 100 draws or urges flows of air F into casing 110, e.g., in the manner described above. Impeller assembly 100 may be in mechanical communication with motor 28 of dryer appliance 10. Thus, impeller assembly 100 may be rotatable about the axis of rotation X by motor 28 in order to urge flows of air F into casing 110. In particular, motor 28 can rotate or spin impeller assembly 100 on the axis of rotation X in order to draw moisture laden air $A_m$, from chamber 27 of drum 26 and urge moisture laden air $A_m$, to vent 49 of cabinet 12 in the manner described above. It should be understood that impeller assembly 100 may be rotatable about the axis of rotation X by any suitable motor. For example, dryer appliance 10 may include an additional motor (not shown) that can rotate impeller assembly 100 independently of drum 26.

Figure 5:
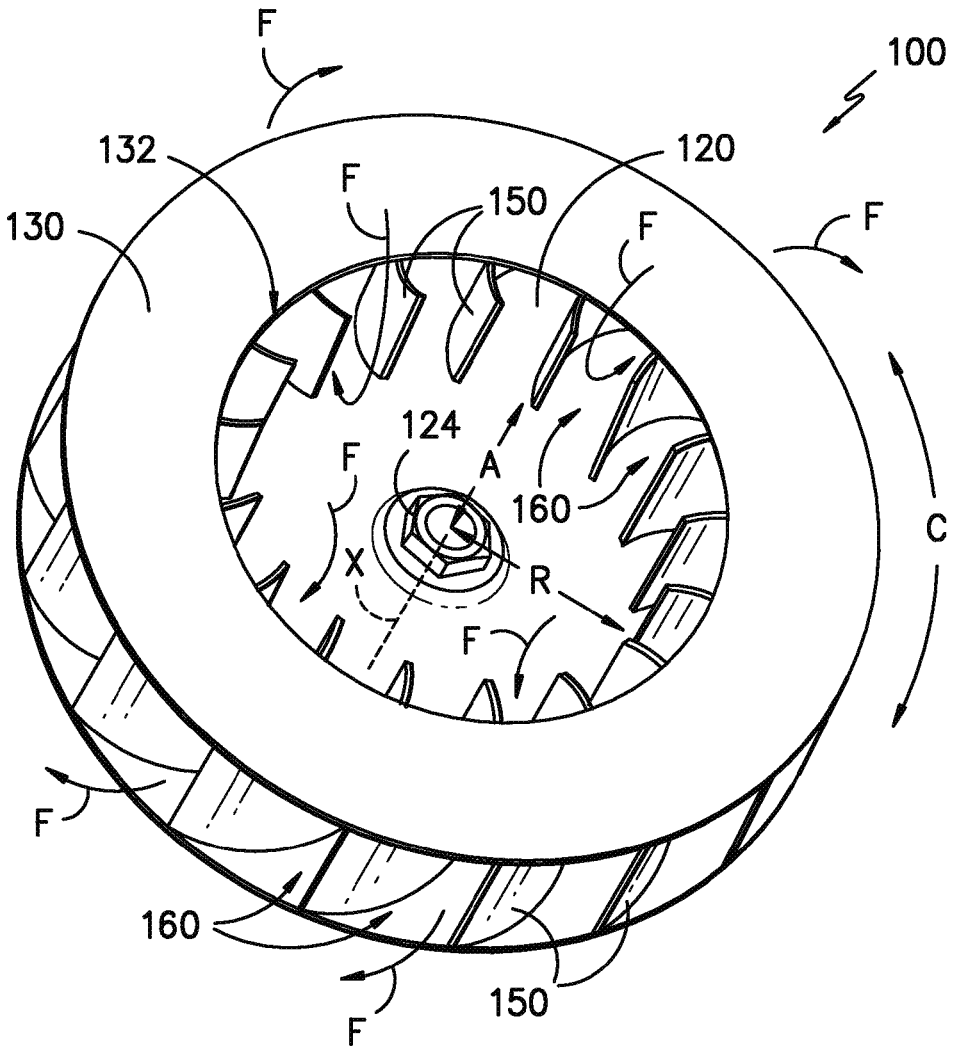
FIG. 5 provides a perspective view of the exemplary impeller assembly of FIG. 3.

FIG. 5 provides a perspective view of impeller assembly 100. As may be seen in FIG. 5, impeller assembly 100 defines a radial direction R, a circumferential direction C and an axial direction A. The axis of rotation X may be substantially parallel to the axial direction A, e.g., such that the axis of rotation X is substantially perpendicular to the radial direction R and circumferential direction C. Impeller assembly 100 includes a base plate 120, an annular front plate 130 and a plurality of blades 150. Base plate 120, annular front plate 130 and blades 150 define a plurality of passages 160 for directing flows of air F during rotation of impeller assembly 100 about the axis of rotation X.

Base plate 120 has a substantially circular shape, e.g., in a plane that is perpendicular to the axial direction A, such that base plate 120 is substantially disk-shaped. Base plate 120 includes a mounting feature 124 for mounting base plate 120 to a motor, such as motor 28. Mounting feature 124 is positioned at the axis of rotation X and can be any suitable mechanism for mounting impeller assembly 100 to the motor. For example, mounting feature 124 may include threads for securing impeller assembly 100 to the motor.

Annular front plate 130 is spaced apart from base plate 120, e.g., along the axial direction A. Further, annular front plate 130 is positioned up stream of base plate 120 relative to flow of air F (FIG. 3). Annular front plate 130 is substantially ring-shaped e.g., in a plane that is perpendicular to the axial direction A. Thus, annular front plate 130 defines an opening 132 that permits flow of air F therethrough during rotation of impeller assembly 100 about the axis of rotation X.

Blades 150 extend between base plate 120 and annular front plate 130, e.g., along the axial direction A. Thus, base plate 120 and annular front plate 130 may be coupled together with blades 150. Blades 150 are spaced apart from each other, e.g., along the circumferential direction C. In particular, blades 150 may be spaced apart from each other such that blades 150 are uniformly dispersed or distributed along the circumferential direction C. As discussed in greater detail below, base plate 120, annular front plate 130 and blades 150 are sized, shaped and oriented for drawing flows of air F during rotation of impeller assembly 100 about the axis of rotation X.

Figure 6:
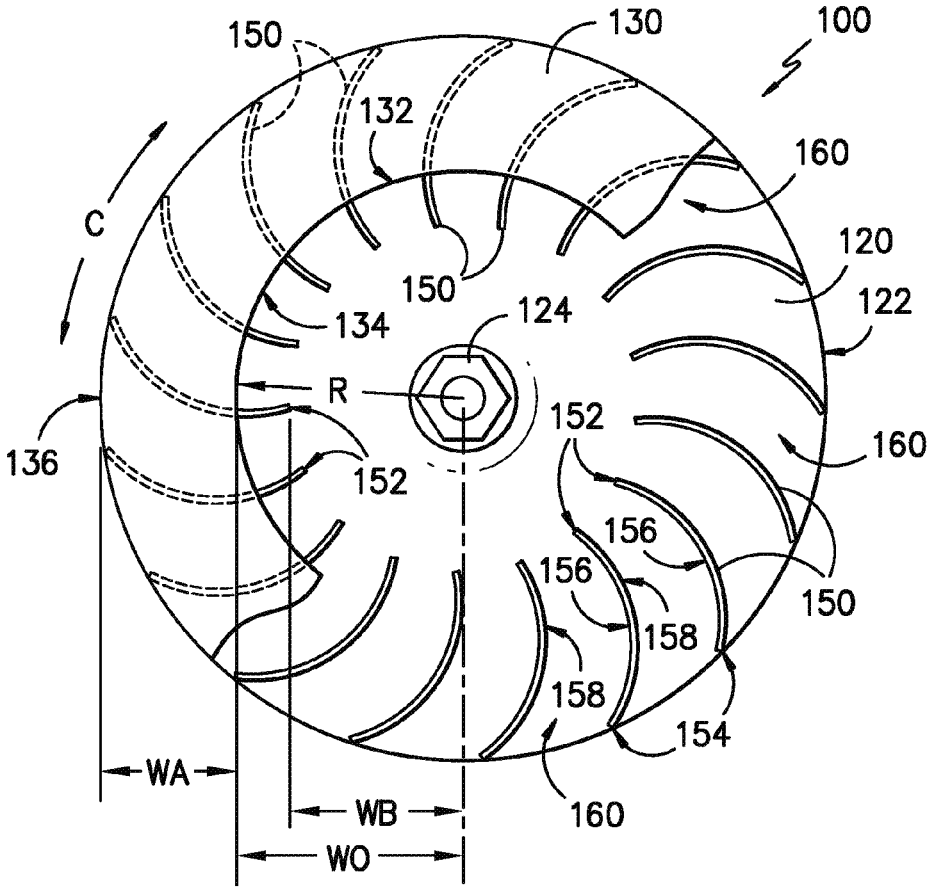
FIG. 6 provides a top, plan view of the exemplary impeller assembly of FIG. 3 with a portion of an annular front plate of the exemplary impeller assembly removed.
Figure 7:
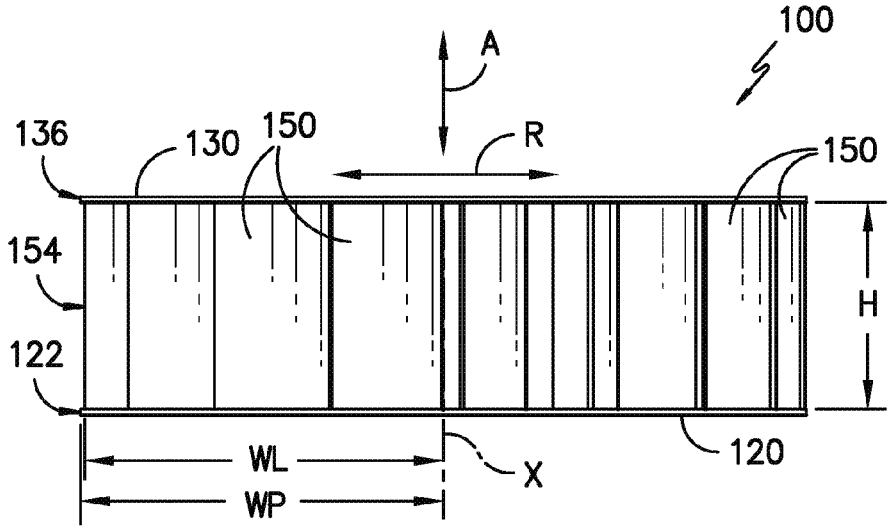
FIG. 7 provides a side, elevation view of the exemplary impeller assembly of FIG. 3.

FIG. 6 provides a top, plan view of impeller assembly 100 with a portion of annular front plate 130 removed for clarity. FIG. 7 provides a side, elevation view of the impeller assembly 100. As may be seen in FIG. 6, each blade of blades 150 extends between an inner or leading edge 152 and an outer or trailing edge 154, e.g., along the radial direction R. Further, each blade of blades 150 defines an arcuate or curved shape, e.g., in a plane that is perpendicular to the axial direction A, between about the leading and trailing edges 152 and 154 of each blade. Thus, each blade of blades 150 includes a concave surface 156 and a convex surface 158 positioned on opposite sides of each blade such that the concave and convex surfaces 156 and 158 of each blade are spaced apart from each other along the circumferential direction C. As may be seen in FIG. 6, concave surface 156 of one of blades 150 and convex surface 158 of an adjacent one of blades 150 define one of passages 160 therebetween. The arcuate or curved shape of blades 150 can assist with urging flows of air F through passages 160 during rotation of impeller assembly 100 about the axis of rotation X.

As may also be seen in FIG. 6, annular front plate 130 includes an inner edge 134 and an outer edge 136. Inner and outer edges 134 and 136 of annular front plate 130 are spaced apart from each other, e.g., along the radial direction R. Inner edge 134 of annular front plate 130 is positioned at and assists with defining opening 132 of annular front plate 130. Outer edge 136 of annular front plate 130 is also positioned at or adjacent trailing edge 154 of blades 150. Thus, outer edge 136 of annular front plate 130 and trailing edge 154 of blades 150 can coincide with each other along the radial direction R.

Inner edge 134 of annular front plate 130 is also spaced apart from the axis of rotation X along the radial direction R. In particular, inner edge 134 of annular front plate 130 may be spaced apart from the axis of rotation X by a width, WO, along the radial direction R. Thus, opening 132 can be defined a radius along the radial direction R of about the width WO. The width WO can be substantially constant along the circumferential direction C, e.g., such that opening 132 defines a substantially circular shape in a plane that is perpendicular to the axial direction A.

As discussed above, each blade of blades 150 has a respective leading edge 152. Leading edge 152 of blades 150 is spaced apart from the axis of rotation X along the radial direction R. In particular, leading edge 152 of blade 150 may be spaced apart from the axis of rotation X by a width, WB, along the radial direction R. A ratio of the width WO to the width WB can be any suitable value. For example, the ratio of the width WO to the width WB may be greater than about one and one tenth (1.1) and less than about one and one half (1.5). As another example, the ratio of the width WO to the width WB may be greater than about one and two tenths (1.2) and less than about one and one half (1.5).

As discussed above, outer edge 136 of annular front plate 130 is spaced apart from inner edge 134 of annular front plate 130 along the radial direction R. In particular, outer edge 136 of annular front plate 130 may be spaced apart from inner edge 134 of annular front plate 130 by a width, WA, along the radial direction R. Thus, annular front plate 130 extends along the radial direction R by the width WA between the inner and outer edges 134 and 136 of annular front plate 130. The width WA can be substantially constant along the circumferential direction C.

Turning now to FIG. 7, annular front plate 130 is spaced apart from base plate 120 by a height, h, along the axial direction A. A ratio of the width WA to the height h can be any suitable value. For example, the ratio of the width WA to the height h may be being greater than about six tenths (0.6) and less than about one and two tenths (1.2). As another example, the ratio of the width WA to the height h may be being greater than about sixty five hundredths (0.65) and less than about eight tenths (0.8).

As may be seen in FIG. 7, base plate 120 also has an outer edge 122. Outer edge 122 of base plate 120 is spaced apart from the axis of rotation X, e.g., along the radial direction R. In particular, outer edge 122 of base plate 120 is spaced apart from the axis of rotation X by a width, WP, along the radial direction R. The width WP can be substantially constant along the circumferential direction C. Thus, base plate 120 can define a circular shape with a radius along the radial direction R of about the width WP.

As discussed above, each blade of blades 150 has a respective trailing edge 154. Trailing edge 154 of blades 150 is spaced apart from the axis of rotation X along the radial direction R. In particular, trailing edge 154 of each blade is spaced apart from the axis of rotation X by a width, WL, along the radial direction R. A ratio of the width WP to the width WL can be any suitable value. For example, the ratio of the width WP to the width WL may be greater than about eight tenths (0.8).

As discussed above, base plate 120, annular front plate 130 and blades 150 are sized, shaped and oriented for drawing flows of air F during rotation of impeller assembly 100 about the axis of rotation X. In particular, proper selection of the ratio of the width WO to the width WB, the ratio of the width WP to the width WL and/or the ratio of the width WA to the height h can assist with drawing flows of air F during rotation of impeller assembly 100 about the axis of rotation X. For example, such sizing, shaping and orientation can assist with providing a relatively high pressure rise in flows of air F and relatively large flow rates for flows of air F. By adding annular front plate 130, flows of air F can have a higher flow rate in passages 160 while permitting less air to enter a gap between a front portion of impeller assembly 100 and casing 110.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining a vent;

a drum rotatably mounted within the cabinet, the drum defining a chamber for receipt of articles for drying;

a conduit that connects the chamber of the drum and the vent of the cabinet such that the chamber of the drum and the vent of the cabinet are in fluid communication;

a motor; and an impeller assembly, the impeller assembly having an axis of rotation about which the impeller assembly is rotatable, the impeller assembly being in mechanical communication with the motor; the impeller assembly rotatable about the axis of rotation by the motor in order to urge a flow of air from the chamber of the drum to the vent of the cabinet through the conduit, the impeller assembly defining a radial direction, a circumferential direction and an axial direction, the impeller assembly comprising:

a base plate;

an annular front plate spaced apart from the base plate along the axial direction, the annular front plate having an inner edge that is spaced apart from the axis of rotation of the impeller assembly by a width, WO, along the radial direction; and a plurality of blades extending between the base plate and the annular front plate along the axial direction, the plurality of blades spaced apart from each other along the circumferential direction, each blade of the plurality of blades having a leading edge, the leading edge of each blade of the plurality of blades spaced apart from the axis of rotation of the impeller assembly by a width, WB, along the radial direction, a ratio of the width WO to the width WB being greater than about one and one tenth and less than about one and one half.

2. The dryer appliance of claim 1, wherein the annular front plate is spaced apart from the base plate by a height, h, along the axial direction, the annular front plate having an outer edge that is spaced apart from the inner edge of the annular front plate by a width, WA, along the radial direction, a ratio of the width WA to the height h being greater than about six tenths and less than about one and two tenths.

3. The dryer appliance of claim 1, wherein the base plate has an outer edge that is spaced apart from the axis of rotation of the impeller assembly by a width, WP, along the radial direction, each blade of the plurality of blades having a trailing edge, the trailing edge of each blade of the plurality of blades spaced apart from the axis of rotation of the impeller assembly by a width, WL, along the radial direction, a ratio of the width WP to the width WL being greater than about eight tenths.

4. The dryer appliance of claim 1, wherein the base plate is mounted to the motor.

5. The dryer appliance of claim 1, wherein the motor is in mechanical communication with the drum and is configured for rotating the drum.

6. The dryer appliance of claim 1, wherein each blade of the plurality of blades defines an arcuate shape in a plane that is perpendicular to the axial direction.

7. A dryer appliance, comprising:

a cabinet defining a vent;

a drum rotatably mounted within the cabinet, the drum defining a chamber for receipt of articles for drying;

a conduit that connects the chamber of the drum and the vent of the cabinet such that the chamber of the drum and the vent of the cabinet are in fluid communication;

a motor; and an impeller assembly, the impeller assembly having an axis of rotation about which the impeller assembly is rotatable, the impeller assembly being in mechanical communication with the motor; the impeller assembly rotatable about the axis of rotation by the motor in order to urge a flow of air from the chamber of the drum to the vent of the cabinet through the conduit, the impeller assembly defining a radial direction, a circumferential direction and an axial direction, the impeller assembly comprising:

a base plate;

an annular front plate spaced apart from the base plate by a height, h, along the axial direction, the annular front plate having an inner edge and an outer edge, the inner edge of the annular front plate spaced apart from the axis of rotation of the impeller assembly along the radial direction, the outer edge of the annular front plate spaced apart from the inner edge of the annular front plate by a width, WA, along the radial direction, a ratio of the width WA to the height h being greater than about six tenths and less than about one and two tenths; and a plurality of blades extending between the base plate and the annular front plate along the axial direction, the plurality of blades spaced apart from each other along the circumferential direction.

8. The dryer appliance of claim 7, wherein the inner edge of the annular front plate is spaced apart from the axis of rotation of the impeller assembly by a width, WO, along the radial direction, each blade of the plurality of blades having a leading edge, the leading edge of each blade of the plurality of blades spaced apart from the axis of rotation of the impeller assembly by a width, WB, along the radial direction, a ratio of the width WO to the width WB being greater than about one and one tenth and less than about one and one half.

9. The dryer appliance of claim 7, wherein the base plate has an outer edge that is spaced apart from the axis of rotation of the impeller assembly by a width, WP, along the radial direction, each blade of the plurality of blades having a trailing edge, the trailing edge of each blade of the plurality of blades spaced apart from the axis of rotation of the impeller assembly by a width, WL, along the radial direction, a ratio of the width WP to the width WL being greater than about eight tenths.

10. The dryer appliance of claim 7, wherein the base plate is mounted to the motor.

11. The dryer appliance of claim 7, wherein the motor is in mechanical communication with the drum and is configured for rotating the drum.

12. The dryer appliance of claim 7, wherein each blade of the plurality of blades defines an arcuate shape in a plane that is perpendicular to the axial direction.

13. A dryer appliance, comprising:

a cabinet defining a vent;

a drum rotatably mounted within the cabinet, the drum defining a chamber for receipt of articles for drying;

a conduit that connects the chamber of the drum and the vent of the cabinet such that the chamber of the drum and the vent of the cabinet are in fluid communication;

a motor; and an impeller assembly, the impeller assembly having an axis of rotation about which the impeller assembly is rotatable, the impeller assembly being in mechanical communication with the motor; the impeller assembly rotatable about the axis of rotation by the motor in order to urge a flow of air from the chamber of the drum to the vent of the cabinet through the conduit, the impeller assembly defining a radial direction, a circumferential direction and an axial direction, the impeller assembly comprising:

a base plate having an outer edge that is spaced apart from the axis of rotation of the impeller assembly by a width, WP, along the radial direction;

an annular front plate spaced apart from the base plate along the axial direction; and a plurality of blades extending between the base plate and the annular front plate along the axial direction, the plurality of blades spaced apart from each other along the circumferential direction, each blade of the plurality of blades having a trailing edge, the trailing edge of each blade of the plurality of blades spaced apart from the axis of rotation of the impeller assembly by a width, WL, along the radial direction, a ratio of the width WP to the width WL being greater than about eight tenths.

14. The dryer appliance of claim 13, wherein the annular front plate has an inner edge that is spaced apart from the axis of rotation of the impeller assembly by a width, WO, along the radial direction, each blade of the plurality of blades having a leading edge, the leading edge of each blade of the plurality of blades spaced apart from the axis of rotation of the impeller assembly by a width, WB, along the radial direction, a ratio of the width WO to the width WB being greater than about one and one tenth and less than about one and one half.

15. The dryer appliance of claim 13, wherein the annular front plate is spaced apart from the base plate by a height, h, along the axial direction, the annular front plate having an outer edge that is spaced apart from the inner edge of the annular front plate by a width, WA, along the radial direction, a ratio of the width WA to the height h being greater than about six tenths and less than about one and two tenths.

16. The dryer appliance of claim 13, wherein the base plate is mounted to the motor.

17. The dryer appliance of claim 13, wherein the motor is in mechanical communication with the drum and is configured for rotating the drum.

18. The dryer appliance of claim 13, wherein each blade of the plurality of blades defines an arcuate shape in a plane that is perpendicular to the axial direction.

* * * * *